US006648328B2

(12) United States Patent
Sugimoto

(10) Patent No.: US 6,648,328 B2
(45) Date of Patent: Nov. 18, 2003

(54) SHEET TRANSFER DEVICE WITH GUIDE PLATES AND HOLD ROLLERS

(75) Inventor: Hiroyuki Sugimoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 9 days.

(21) Appl. No.: 09/969,884

(22) Filed: Oct. 4, 2001

(65) Prior Publication Data

US 2002/0038931 A1 Apr. 4, 2002

(30) Foreign Application Priority Data

Oct. 4, 2000 (JP) ..... 2000-305044

(51) Int. Cl.[7] ..... B65H 5/06

(52) U.S. Cl. ..... 271/273; 271/274; 400/625; 400/637.2; 400/645.4; 400/645.5

(58) Field of Search ..... 271/272, 274, 271/273, 314, 275; 400/625, 636, 637.2, 639.1, 645, 645.4, 645.5

(56) References Cited

U.S. PATENT DOCUMENTS 4,621,802 A * 11/1986 Ishida et al. ..... 271/272
5,265,868 A * 11/1993 Bowser et al. ..... 271/274
5,344,134 A * 9/1994 Saeki et al. ..... 271/122
5,527,123 A * 6/1996 Jackson et al. ..... 400/642
5,620,174 A * 4/1997 Taniguro et al. ..... 271/10.12
5,673,074 A * 9/1997 Miyauchi et al. ..... 347/104
6,089,773 A * 7/2000 Bailey et al. ..... 400/642
6,260,844 B1 * 7/2001 Naeser et al. ..... 271/272
6,293,669 B1 * 9/2001 Uchida ..... 347/104
6,336,759 B1 * 1/2002 Nakano ..... 400/625
6,343,787 B1 * 2/2002 Kato et al. ..... 271/274
6,345,819 B1 * 2/2002 Bae ..... 271/272

FOREIGN PATENT DOCUMENTS

JP 2000-206638 * 7/2000

* cited by examiner

*Primary Examiner*—Patrick Mackey
(74) *Attorney, Agent, or Firm*—Kanesaka & Takeuchi

(57) ABSTRACT

To prevent wavy swell from causing in sheet in transferring thereof and avoid wrinkle from being produced in later printing steps, there is provided a sheet transfer machine forward from a printing drum and a press roll. The machine is provided with upper and lower guide plates respectively formed with hole portions. Upper and lower rolls are disposed at the hole portions. There are provided hold rollers for pressing sheet coming from between the upper and the lower guide plates to an upper face of the lower guide plate downstream from the upper roll in a direction of transferring print sheet. In printing, swell is prevented from being produced by pressing the print sheet coming from between the two rolls by the hold rollers. When the sheet is sandwiched by the printing drum and the press roll and printed in later steps, wrinkle is not produced in the print sheet.

6 Claims, 6 Drawing Sheets

SHEET TRANSFER DEVICE WITH GUIDE PLATES AND HOLD ROLLERS

BACKGROUND OF THE INVENTION AND RELATED ART STATEMENT

The present invention relates to a sheet transfer machine useful for supplying sheet such as print sheet to an image forming portion of a printing section in an image forming machine of a printing machine.

A stencil printing machine as an image forming machine is generally provided with an ink supply mechanism at an inner portion thereof. The stencil printing machine includes a printing drum wound with perforated stencil sheet at an outer peripheral face thereof and driven to rotate and a printing section having pressing means for pressing print sheet to the printing drum. Further, the stencil printing machine is provided with a sheet transfer machine as a sheet supply machine and print sheet transferred therefrom is supplied to between the rotating printing drum and the pressing means.

FIG. 6 views a conventional sheet supply machine in a section orthogonal to a sheet supply direction. The sheet supply machine is provided with an upper guide plate 100 and a lower guide plate 101. The upper guide plate 100 and the lower guide plate 101 are arranged in parallel with each other at an interval therebetween. The upper guide plate 100 and the lower guide plate 101 are formed with hole portions at positions in correspondence with each other. The hole portions are provided with a pair of upper and lower guide roll 102 and timing roll 103. The two rolls 102 and 103 are constituted in a shape of comb teeth by being divided into pluralities of portions in axial directions.

Print sheet 1 constituting a sheet-like object supplied from the back face side of FIG. 6 is brought into an interval between the upper guide plate 100 and the lower guide plate 101. The print sheet 1 is sandwiched by the guide roll 102 and the timing roll 103 and is transferred to this side of FIG. 6. Although details are not illustrated, at a front side of a transfer direction, there is brought about a state in which the upper guide plate 100 is interrupted and only the lower guide plate 101 is extended to the front side. Further, the print sheet 1 comes out from between the upper and the lower guide plates 100 and 101 and guided along an upper face of the guide plate 101. At this occasion, as shown in FIG. 6, the print sheet 1 is transferred by being sandwiched by the pair of rolls 102 and 103 in the shape of comb teeth and therefore, there is brought about a state in which a swell (portion 1*a* of print sheet 1 formed in a wavy shape) is produced upwardly at a position of a gap between the two rolls 102 and 103 in the axial direction. That is, it seems that since the print sheet 1 is transferred by being sandwiched by the rolls in the shape of comb teeth, pressed states of the sheet differ at a location where the sheet is sandwiched and at other location. Accordingly, such a deformation (1*a*) in the wavy shape is caused.

When the print sheet 1 is sandwiched by the printing drum and the pressing means in such a state of causing the swell (deformation 1*a*), there arises a problem that the portion of the swell (deformation 1*a*) is crushed to constitute wrinkle.

It is an object of the invention to prevent a swell in a wavy shape from being caused in sheet in transferring the sheet and avoid the problem of causing wrinkle in later steps.

SUMMARY OF THE INVENTION

According to a first aspect of the invention, there is provided a sheet transfer machine having a guide plate, a first roll and a second roll and a press member. The second roll sandwiches sheet between the first roll and the second roll and transfers the sheet in a predetermined direction along the guide plate. The press member is arranged on a downstream side in the predetermined direction contiguously to the first and the second rolls for pressing sheet to the guide plate.

According to the first aspect of the sheet transfer machine, the sheet is sandwiched between the first roll and the second roll and is transferred in the predetermined direction along the guide plate. At this occasion, a swell is produced in the sheet. The transferred sheet is pressed on the guide plate by the press member. Thereby, the sheet produced with the swell can be brought into a flat state and transferred.

According to a second aspect of the invention, there is provided a sheet transfer machine provided at an image forming machine having an image forming drum driven to rotate and pressing means for forming an image on sheet by pressing the sheet to the image forming drum. The sheet transfer machine supplies the sheet to between the image forming drum and the pressing means. The sheet transfer machine is provided with a guide plate for guiding the sheet, a first roll, a second roll for sandwiching the sheet between the first roll and the second roll and transferring the sheet in a predetermined direction along the guide plate and a press member arranged on a downstream side of the predetermined direction contiguously to the first and the second rolls for pressing the sheet to the guide plate.

According to the second aspect of the sheet transfer machine, the sheet is sandwiched between the first roll and the second roll and guided to the guide plate. The sheet is transferred in the predetermined direction along the guide plate. At this occasion, a swell is produced in the sheet. The transferred sheet is pressed above the guide plate by the pressing members. The sheet produced with the swell is flattened and is supplied between the image forming drum and the pressing means. The sheet is pressed to the image forming drum driven to rotate by the pressing means. At this occasion, the swell is not produced in the sheet and therefore, even when the sheet is sandwiched between the pressing means and the image forming drum, wrinkle is not produced. Further, since image is formed on the sheet which is not produced with wrinkle and therefore, excellent image which is not warped can be formed.

According to a third aspect of the invention, there is provided a sheet transfer machine provided at an image forming machine including an image forming drum driven to rotate and pressing means for pressing sheet to the image forming drum and printing the sheet. The sheet transfer machine supplies the sheet between the image forming drum and the pressing means. The sheet supply machine is provided with guiding means, an upper roll, a lower roll and press members. The guiding means comprises an upper guide plate and a lower guide plate arranged at a predetermined interval therebetween. Hole portions are respectively formed at positions of the upper guide plate and the lower guide plate in correspondence with each other. The upper roll is arranged on an upper side of the upper guide plate proximately to the hole portions of the upper guide plate. The lower roll is arranged on a lower side of the lower guide plate proximately to the hole portions of the lower guide plate. The upper roll and the lower roll sandwich the sheet inserted between the upper guide plate and the lower guide plate therebetween. The upper roll and the lower roll transfer the sheet in a predetermined direction along the guiding means. The press members are arranged on a downstream side of the upper roll in the predetermined direction. The press members press the sheet transferred and coming out from between the upper guide plate and the lower guide plate to an upper face of the lower guide plate.

According to the third aspect of the sheet transfer machine, the sheet is inserted between the upper guide plate and the lower guide plate. The inserted sheet is sandwiched between the upper roll and the lower roll and is transferred in the predetermined direction along the guiding means. A swell (deformation) is produced in the sheet coming out from between the upper guide plate and the lower guide plate. The sheet produced with the swell is pressed by the press member at the upper face of the lower guide plate. Thereby, the sheet produced with the swell is flattened and is supplied between the image forming drum and the pressing means. The sheet is pressed to the image forming drum driven to rotate by the pressing means. At this occasion, the sheet is not produced with the swell and therefore, even when the sheet is sandwiched by the pressing means and the image forming drum, wrinkle is not produced. Further, the sheet which is not produced with the wrinkle is subjected to printing and therefore, excellent printing without warping can be carried out.

According to a fourth aspect of the invention, there is provided a sheet transfer machine wherein in the sheet transfer machine according to the third aspect, the press member is a hold roller which is brought into contact with the upper face of the lower guide plate movably in the up and down directions at a vicinity of an end edge of the upper guide late.

According to the fourth aspect of the sheet transfer machine, since the hold roller is used as the press member and therefore, the sheet produced with the swell coming out from between the upper guide plate and the lower guide plate is pressed by the hold roller above the lower guide plate and is brought into a flat state. And the hold roller is rotated by transferring the sheet. Thereby, the sheet can smoothly be transferred to direct to between the image forming drum and the pressing means.

According to a fifth aspect of the invention, there is provided a sheet transfer machine wherein in the sheet transfer machine according to the third aspect, the upper roll and the lower roll are divided into plural portions by interposing gap portions thereamong in the axial directions. The press members are arranged at positions contiguously to the gap portions in the predetermined direction.

According to the fifth aspect of the sheet transfer machine, the upper roll and the lower roll are divided into plural portions by interposing the gap portions thereamong in the axial directions in correspondence with a size of the sheet. Therefore, even when any size of the sheet is transferred, the sheet coming out from between the upper guide plate and the lower guide plate is produced with swells (deformations) at the gap portions between the upper roll and the lower roll. Portions of the sheet produced with the swells are pressed by the press members at the upper face of the lower guide plate. Thereby, the sheet produced with the swell is flattened and supplied to an interval between the image forming drum and the pressing means.

According to a sixth aspect of the invention, there is provided a sheet transfer machine which herein in the sheet transfer machine according to the third aspect, the upper roll and the lower roll are respectively single roll members. At least one of the press members is arranged at a position contiguous, in the predetermined direction, to central positions in the axial directions of the upper roll and the lower roll.

According to the sixth aspect of the sheet transfer machine, the upper roll and the lower roll are respectively single roll members and therefore, a number of parts can be reduced and in comparison with the case of using a plurality of the respective rolls, the maintenance can be facilitated. Further, since the two rolls are single roll members, there is frequently a case in which the sheet coming out from between the upper guide plate and the lower guide plate is produced with a swell (deformation) substantially at centers in the axial directions of the two rolls. Therefore, by arranging the pressing member at least to the central positions in the axial directions of the two rolls, the swell is crushed effectively and the sheet can be transferred in the flat state.

DETAILED DESCRIPTION OF THE PREFERRED EMBODIMENT

An explanation will be given of a first example of an embodiment according to the invention in reference to FIG. 1 through FIG. 4.

Figure 1:
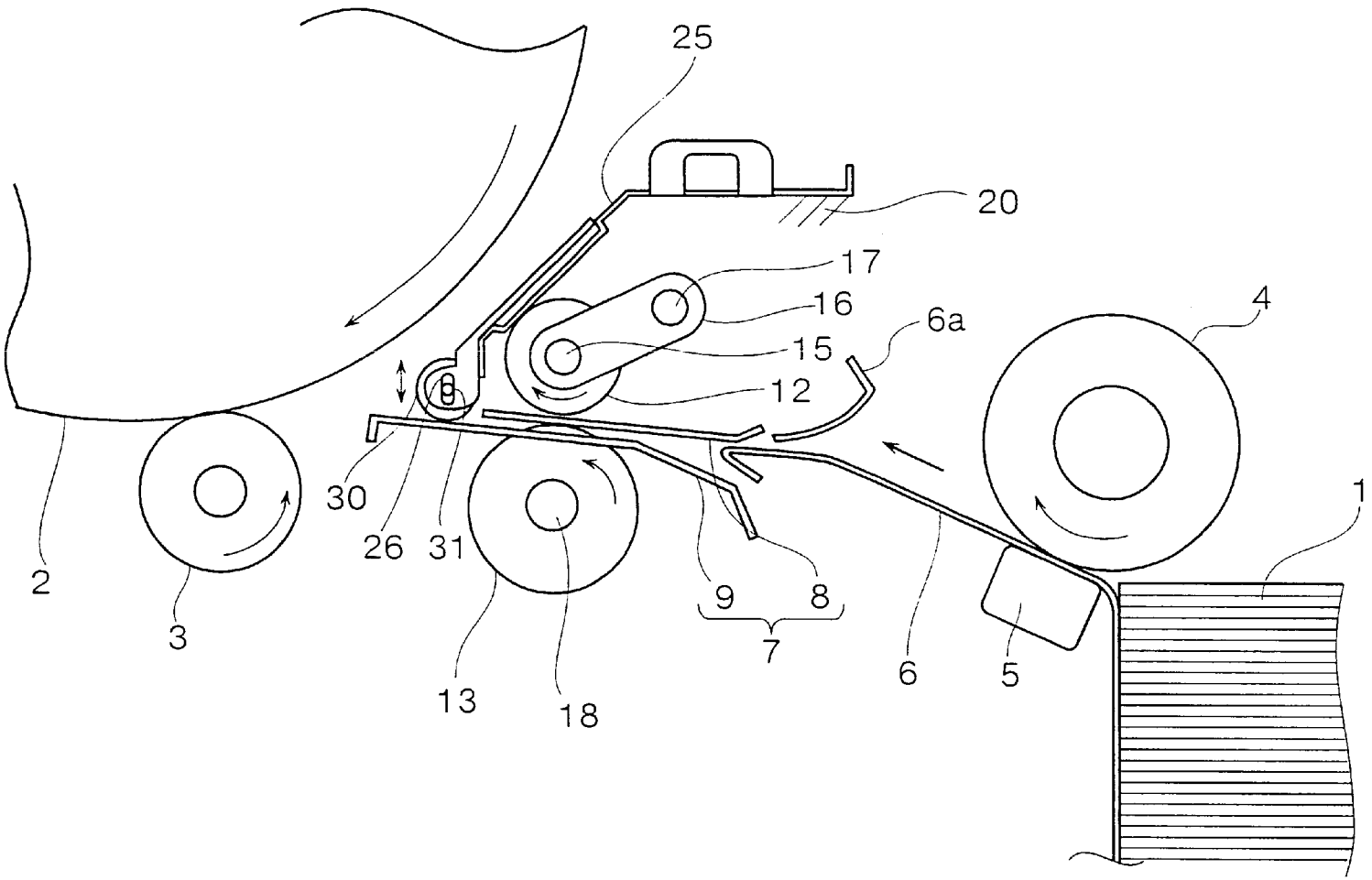
FIG. 1 is a front view showing essential portions of a first example according to an embodiment of the invention.

FIG. 1 is a sectional view of essential portions of a stencil printing machine constituting an image forming machine. A printing section of the stencil printing machine is provided with a printing drum 2 (image forming drum) driven to rotate at a predetermined position. A peripheral wall of the printing drum 2 is ink-permeable and an outer peripheral face of the peripheral wall is wound with perforated stencil sheet. Further, ink supplying means is provided at an inner portion of the printing drum 2. A press roll 3 (pressing means) is liftably provided on a lower side of the printing drum 2. The press roll 3 presses print sheet 1 to the rotating printing drum 2 to thereby carry out printing.

A sheet supply machine for supplying the loaded print sheet 1 to the printing drum 2 is provided on the upstream side of the printing section in the transfer direction of the print sheet 1. First, the sheet supply machine is provided with a pickup roll 4 which is brought into contact with the topmost of print sheet 1 and a separating base 5 which is brought into contact with the pickup roll 4. The topmost print sheet 1 is separated from the loaded print sheets 1 while being sandwiched between the pickup roll 4 and the separating base 5. The separated print sheet 1 is transferred to the front side along a guide plate 6. An introducing plate **6*a* and guiding means 7 are arranged at the front side of the guide plate 6. The guiding means 7 is constituted by an upper guide plate 8 and a lower guide plate 9 arranged at a predetermined interval therebetween. At an inlet side of the guiding means 7, the upper guide plate 8 and the lower guide plate 9 are opened to facilitate to receive the print sheet 1 coming out from the guide plate 6** and the introducing plate 6*a*. At an outer side of the guiding means 7, the upper guide plate 8 is interrupted and the lower guide plate 9 is extended substantially horizontally toward an interval between the printing drum 2 and the press roll 3.

Figure 2:
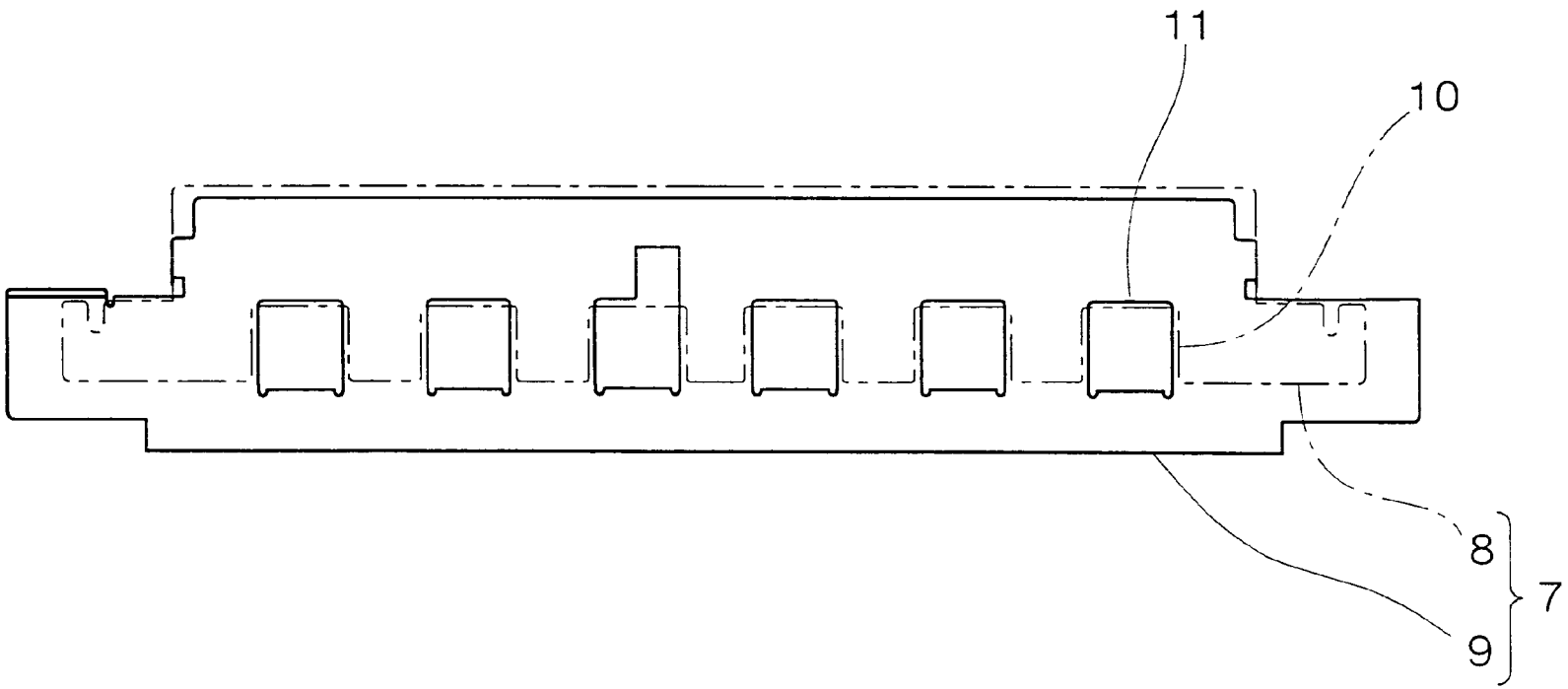
FIG. 2 is a plan view of a lower guide plate according to the first example.

At substantially a middle position of the inlet and the outlet of the guiding means 7, and at positions of the upper guide plate 8 and the lower guide plate 9 in correspondence with each other, there are formed plural hole portions 10 and 11 respectively independent from each other at predetermined intervals. As shown in FIG. 2, although the hole portion 11 of the lower guide plate 9 is an independent hole, the surrounding of which is closed, the hole portion 10 of the upper guide plate 8 is formed substantially in a shape of a rectangular groove opened to the front side.

Further, proximately to the hole portions 10 of the upper guide plate 8, there is arranged an upper roll 12 on an upper side of the upper guide plate 8. The upper roll 12 is a driven roll and the upper roll 12 is formed in a shape of comb teeth divided in the plurality of portions in the axial direction and the interval is pertinently determined in correspondence with widths of sheet of various sizes and is set such that even with any size of sheet, the roll is disposed at both ends thereof in the width direction to thereby enable to press the sheet. Both ends of a rotating shaft 15 of the upper roll 12 are supported by front ends of a pair of arms 16. Rear ends of the pair of arms 16 are pivotably supported by a support shaft 17. The support shaft 17 is supported by frames 20 constituting stationary portions of the machine. Further, the upper roll 12 supported by the rotating shaft 15 can be pivoted upwardly and downwardly centering on the support shaft 17 by rotating the support shaft 17.

Proximately to the hole portions 11 of the lower guide plate 9, there is arranged a lower roll 13 on the lower side of the lower guide plate 9. The lower roll 13 is a drive roll. Similar to the upper roll 12, the lower roll 13 is formed in a shape of comb teeth divided by a number the same as that of the upper roll 12 in the axial direction. An interval of the teeth is substantially equivalent to that of the upper roll 12. However, an outer diameter of the lower roll 13 is larger than that of the upper roll 12 and a width of the lower roll 13 is slightly smaller than that of the upper roll 12. Both ends of a drive shaft 18 of the lower roll 13 are supported by the frames 20 constituting the stationary portions of the machine and is cooperatingly connected to driving means, not illustrated.

Therefore, when the upper roll 12 is urged downwardly and is brought into contact with the lower roll 13 in the hole portions 10 and 11 of the guiding means 7, the upper roll 12 is cooperatingly moved by rotating of the lower roll 13. Further, the print sheet 1 inserted between the upper guide plate 8 and the lower guide plate 9 is sandwiched between the upper roll 12 and the lower roll 13 and is transferred in a predetermined direction (left direction in FIG. 1), that is, toward the printing drum 2.

Figure 4:
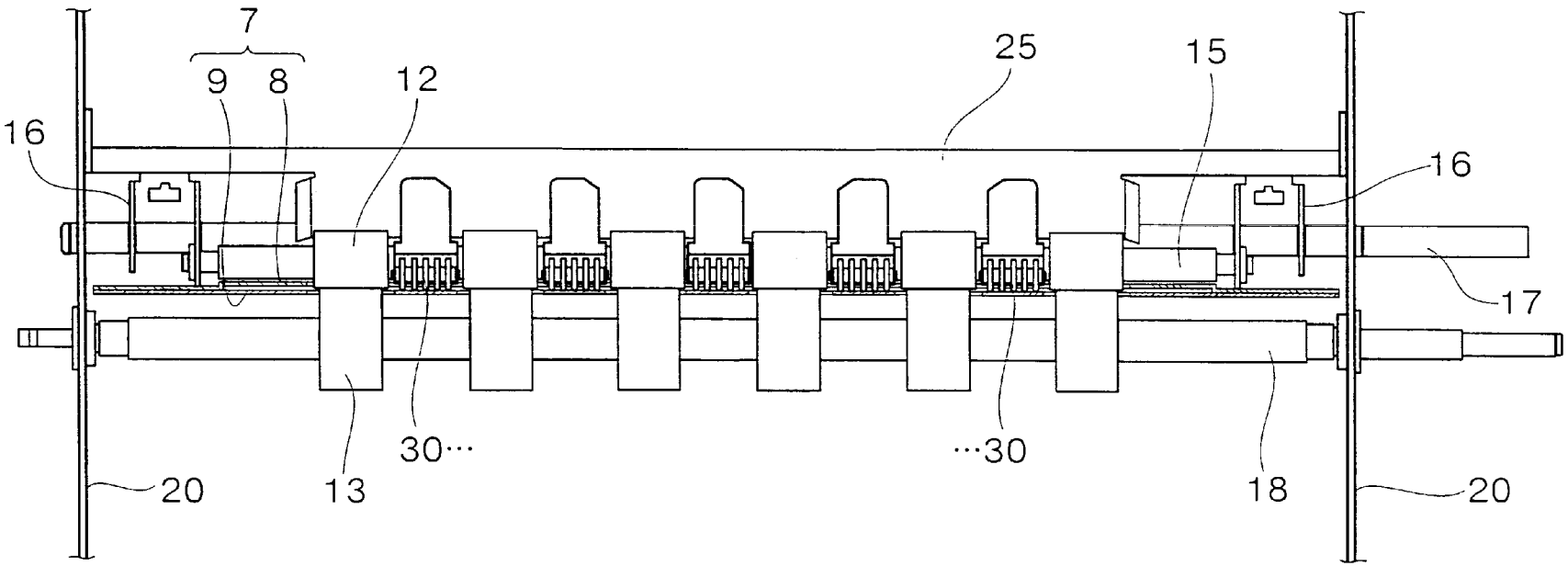
FIG. 4 is a left side view of the vicinities of the hold rollers according to the first example.

A paper supply front cover 25 is arranged on the upper side of the upper roll 12. As shown by FIG. 1 and FIG. 4, a base portion side of the paper supply front cover 25 is fixed to the frames 20 constituting the stationary portions of the machine and a front end thereof is extended in a skewed lower direction and is disposed contiguously to the upper roll 12 in the transfer direction of the print sheet 1.

Figure 3:
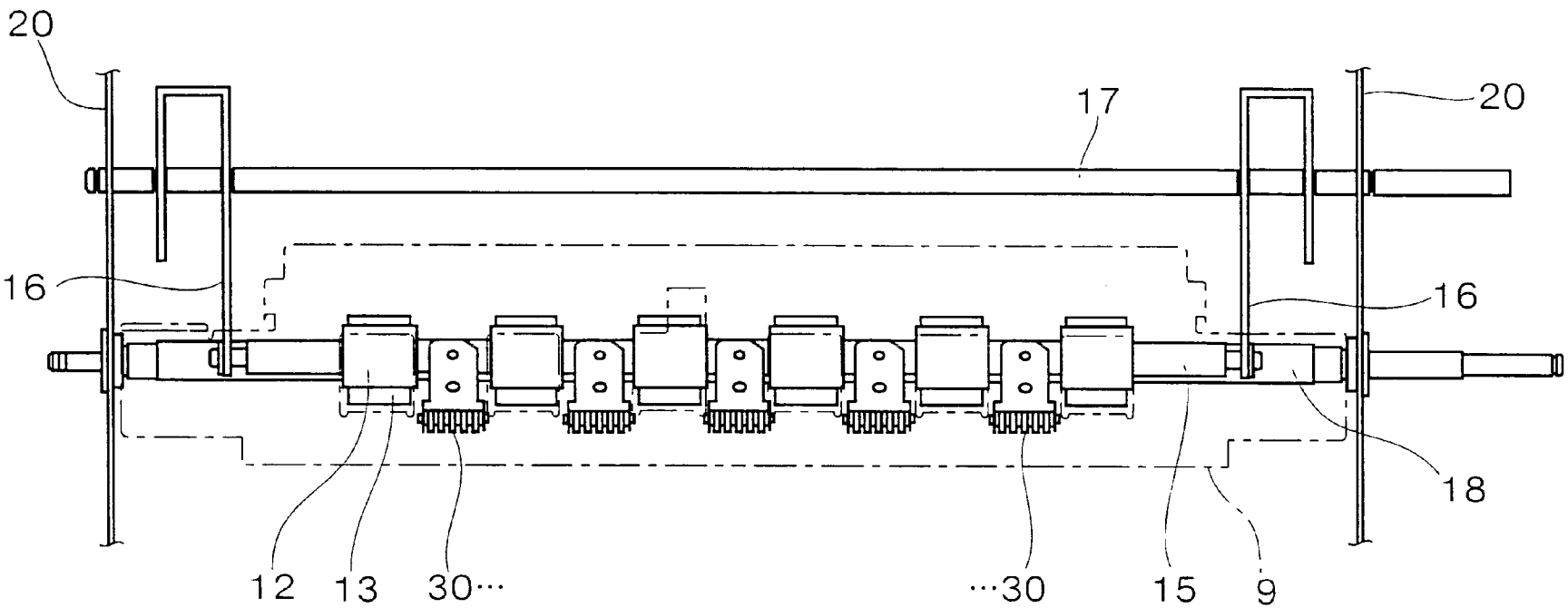
FIG. 3 is a plan view of vicinities of hold rollers according to the first example.

Further, the front end of the paper supply front cover 25 is attached with a plurality of hold rollers 30 as press members. The hold roller 30 is a member made of resin substantially in a cylindrical shape formed with a number of peripheral grooves at a peripheral face thereof. As shown by FIG. 1, the hold roller 30 can freely be moved upwardly and downwardly by engaging a shaft 31 to vertical long holes 26 formed at the front end of the paper supply front cover 25, is brought into contact with an upper face of the lower guide plate 9 by self weight and is freely rotatable. Further, as shown by FIG. 3 and FIG. 4, a position of arranging the hold roller 30 is a position contiguous to a gap portion in the axial direction of the upper roll 12 and the lower roll 13 constituting the shape of comb teeth.

An explanation will be given of operation in the above-described constitution.

In printing, there is brought about a state in which the upper roll 12 is lowered and is brought into contact with the lower roll 13. The topmost print sheet 1 is separated from the loaded print sheets 1 while being sandwiched between the pickup roll 4 and the separating base 5. The separated print sheet 1 is transferred to between the upper guide plate B and the lower guide plate 9. The print sheet 1 is butted to the upper roll 12 and the lower roll 13 in contact with each other at a font end thereof and is at standby in a slightly bent state. When the lower roll 13 starts rotating by setting a timing thereof to rotating operation of the printing drum 2, the print sheet 1 is sandwiched by the two rolls and transferred to the front side.

The print sheet 1 advances toward the printing drum 2 along the upper guide plate 8 and the lower guide plate 9, comes out from the upper guide plate 8 which is short in the transfer direction and is transferred along the upper face of the lower guide plate 9. At this occasion, although conventionally, the swell is produced in the print sheet 1 at the respective gap portion between the upper and the lower rolls 12 and 13 in the shape of comb teeth, such deformation of the print sheet 1 is not produced according to the example since the hold roller 30 arranged in correspondence with the portion presses the print sheet 1. That is, the print sheet 1 is transferred in a flat state, sandwiched between the printing drum 2 and the press roll 3 and is subjected to printing. Therefore, there is not caused the drawback in which the deformed portion is crushed and wrinkle is produced and excellent printed matter with no wrinkle is provided.

Although according to the example, the hold roller 30 is brought into contact with the roller guide plate 9 by its own weight, there may be constructed a constitution in which urging means such as spring is provided and the hold roller 30 is urged downwardly by pertinent force. Further, the weight of the hold roller 30 may be to a degree of capable of straightening the swell produced in the print sheet 1 in accordance with kind (thickness, material or the like) of the print sheet 1 used. Further, the long holes 26 for making the hold rollers 30 liftable, are also provided with a significance of absorbing an integration error in integrating the paper supply front cover 25 and at least the dimension produces an interval between the hold roller 30 and the lower guide plate 9 larger than a thickness of print sheet 1 after attaching the paper supply front cover 25 to the frames 20.

Figure 5:
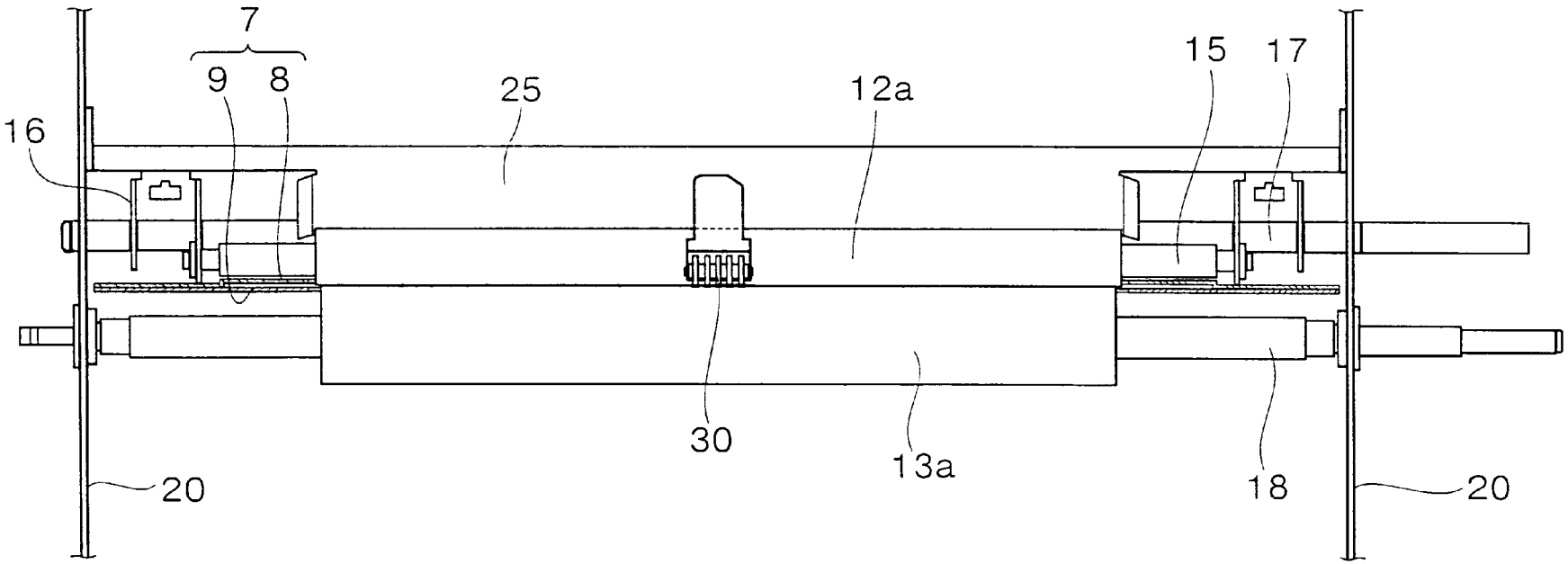
FIG. 5 is a left side view of a vicinity of hold roller according to a second example.
Figure 6:
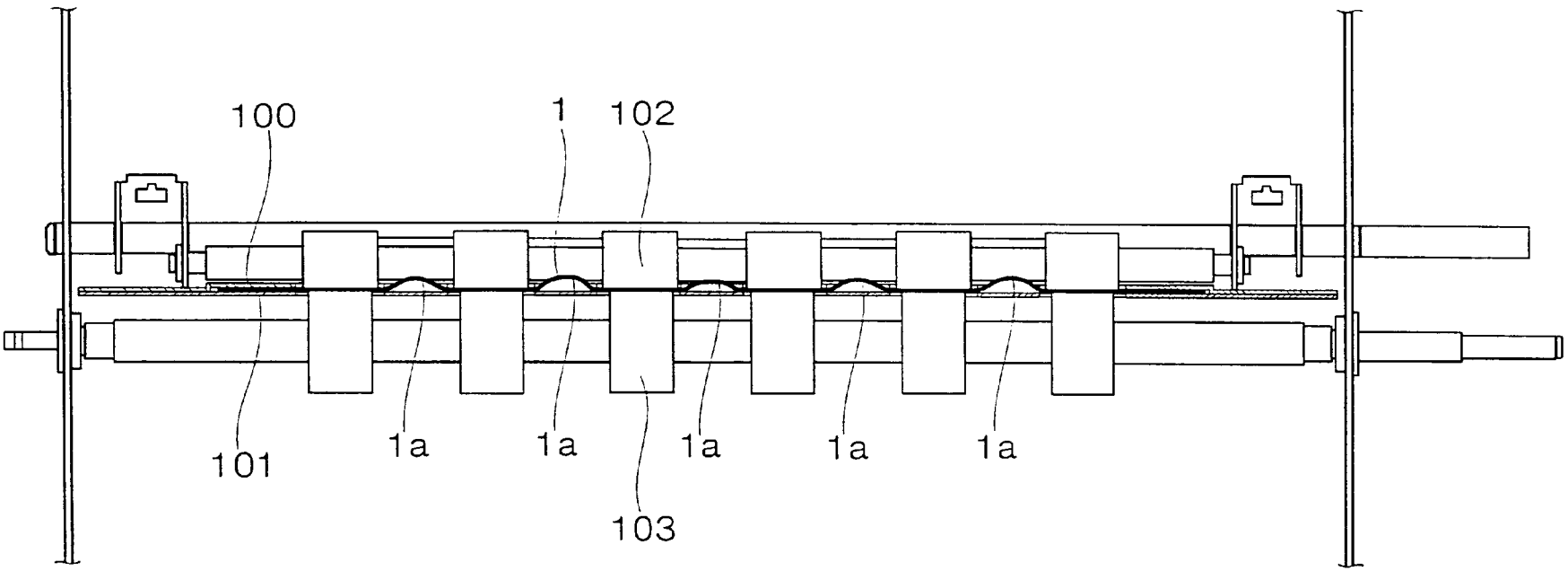
FIG. 6 is a view showing a problem of a conventional sheet transfer machine and is a view in correspondence with FIG. 4 in the example.

Next, an explanation will be given of a second embodiment in reference to FIG. 5.

The example differs from the first example in that the lower roll 13*a* and the upper roll 12*a* are not formed in the shape of comb teeth but are respectively continuous single pieces of rolls. Further, the two examples differ from each other in that in correspondence therewith, shapes of hole portions of the lower guide plate 9 and the upper guide plate 8 are made to differ from those in the first example and a single piece of the hold roller 30 is provided contiguous only to contiguous portions of middle portions in the axial direction of a lower roll 13*a* and an upper roll 12*a*. The other point is basically the same as that in the first example.

When the lower roll 13*a* and the upper roll 12*a* are not formed in the shape of comb teeth but are respectively continuous single pieces of rolls as in the example, generally, there is frequently a case of producing a swell at centers in the axial directions of the two rolls although depending on degrees of adjusting contact pressure of the lower roll 13*a* and the upper roll 12*a*. The degree of the swell is changed also by the contact pressure or the like. Therefore, a single piece of the hold roller 30 may be provided as in the example or two pieces or more of the hold rollers 30 may be provided as necessary.

According to the invention, in the sheet transfer machine for transferring the print sheet along the guide plates by sandwiching the print sheet by the two rolls, the print sheet coming out from between the two rolls is pressed by the press member to thereby prevent the swell from being produced. Therefore, even when the sheet is sandwiched between the printing drum and the press roll and is printed in later steps, there is achieved an effect of not causing the problem of producing wrinkle in the print sheet.

What is claimed is:

1. A sheet transfer machine comprising:

a guide plate for guiding the sheet on an upper surface thereof, a first roll, a second roll located in the guide plate for sandwiching the sheet between the first roll and the second roll to thereby transfer the sheet in a predetermined direction along the guide plate, and a press member arranged on a downstream side of a sheet transfer direction relative to the first and the second rolls, said press member pressing an upper surface of the sheet transferred through the first and second rolls to the upper surface of the guide plate.

2. A sheet transfer machine provided at an image forming machine having an image forming drum driven to rotate and pressing means for forming an image on the sheet by pressing the sheet to the image forming drum, for supplying the sheet to between the image forming drum and the pressing means, comprising:

a guide plate for guiding the sheet on an upper surface thereof, a first roll, a second roll located in the guide plate for sandwiching the sheet between the first roll and the second roll to thereby transfer the sheet in a predetermined direction along the guide plate, and a press member arranged on a downstream side of a sheet transfer direction relative to the first and the second rolls, said press member pressing an upper surface of the sheet transferred through the first and second rolls to the upper surface of the guide plate.

3. A sheet transfer machine provided at an image forming machine comprising an image forming drum driven to rotate and pressing means for pressing the sheet to the image forming drum to thereby print the sheet, for supplying the sheet to between the image forming drum and the pressing means, comprising:

guiding means comprising an upper guide plate and a lower guide plate arranged at a predetermined interval therebetween and formed with hole portions respectively at positions of the upper guide plate and the lower guide plate in correspondence with each other;

an upper roll arranged on an upper side of the upper guide plate proximately to the hole portions of the upper guide plate;

a lower roll arranged on a lower side of the lower guide plate proximately to the hole portions of the lower guide plate for sandwiching the sheet inserted between the upper guide plate and the lower guide plate between the upper roll and the lower roll and transferring the sheet in a predetermined direction along the guiding means; and a press member arranged on a downstream side of the upper roll in the predetermined direction for pressing the sheet coming out from between the upper guide plate and the lower guide plate to an upper face of the lower guide plate.

4. The sheet transfer machine according to claim 3, wherein the press member is a hold roller brought into contact with the upper face of the lower guide plate at a vicinity of an end edge of the upper guide plate movably in up and down directions.

5. The sheet transfer machine according to claim 3, wherein the upper roll and the lower roll are divided in plural portions in axial directions by interposing gap portions thereamong and the press members are arranged at positions contiguous to the gap portions in the predetermined direction.

6. The sheet transfer machine according to claim 3, wherein the upper roll and the lower roll are respectively single roll members and at least one of the press members is arranged at a position contiguous in the predetermined direction to central portions in the axial directions of the upper roll and the lower roll.

* * * * *